United States Patent [19]

Fracarossi

[11] 4,376,420

[45] Mar. 15, 1983

[54] INFLATABLE BOAT INCLUDING A MECHANICAL PROPULSION ASSEMBLY FOR OPERATION BY A USER

[76] Inventor: Bruno Fracarossi, Via Luigi Einaudi 91, Conegliano (Treviso), Italy

[21] Appl. No.: 242,624

[22] Filed: Mar. 11, 1981

Related U.S. Application Data

[63] Continuation-in-part of Ser. No. 960,179, Nov. 13, 1978, abandoned.

[51] Int. Cl.[3] ..... B63B 7/08

[52] U.S. Cl. ..... 114/345; 440/27; 440/91

[58] Field of Search ..... 440/26, 27, 90, 91; 114/345; 441/40, 65, 66

[56] References Cited

U.S. PATENT DOCUMENTS

| | | | |
|---|---|---|---|
| 1,386,918 | 8/1921 | Westrup | 24/201 LP |
| 3,056,980 | 10/1962 | Holladay | 9/310 F |
| 3,179,080 | 4/1965 | Campbell | 9/310 J |
| 3,185,125 | 5/1965 | Haman | 440/27 |
| 3,585,960 | 6/1971 | Shuler | 115/23 |
| 3,694,836 | 10/1972 | Serra | 9/2 A |
| 3,999,501 | 12/1976 | Duarte | 115/23 |

FOREIGN PATENT DOCUMENTS

| | | | |
|---|---|---|---|
| 933157 | 12/1947 | France | 115/23 |
| 1041895 | 6/1953 | France | 115/26.3 |
| 2311711 | of 0000 | France | 115/25 |

*Primary Examiner*—George E. A. Halvosa
*Attorney, Agent, or Firm*—McAulay, Fields, Fisher, Goldstein & Nissen

[57] ABSTRACT

An inflatable boat includes a mechanical propulsion assembly operable by the legs of the user. The inflatable boat has three independent air chambers inflatable to give the boat an operative fork shape. A throw-like shaft mounted in bushes on the branches of the fork shape receives propulsive force from the user's feet. A pair of paddles keyed to the throw-like shaft propel the boat. Shoe-like sheaths may be included on the throw-like shaft for resting the user's feet. When dismantled, the boat does not occupy much space, is easily transportable and is inexpensive.

10 Claims, 11 Drawing Figures

$P_1$
$P_2$
$B_1$
$B_2$
$B_3$
$B_4$
T
D
$E_1$
$E_2$
$S_1$
$S_2$
L
$C_1$
$C_2$
$C_3$
F
$\alpha/2$
$\alpha$

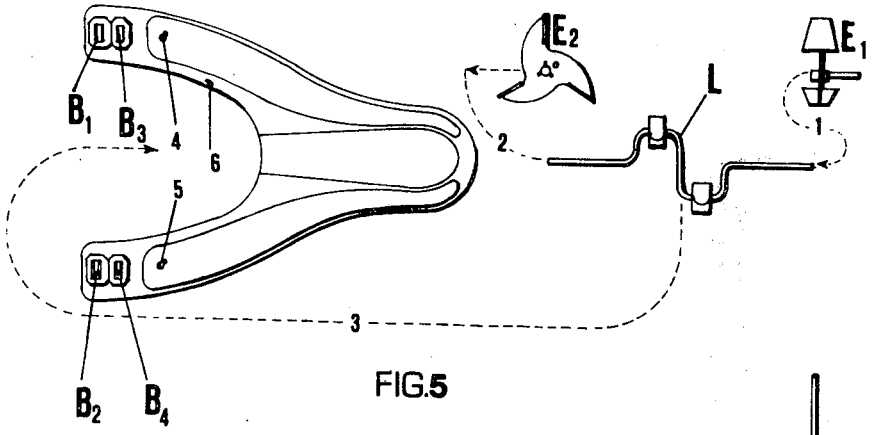
FIG.5
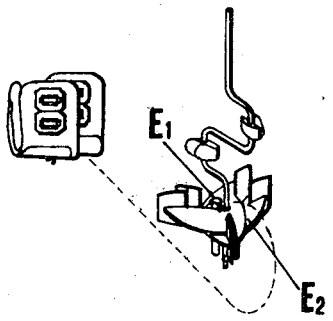
FIG.4
FIG.6
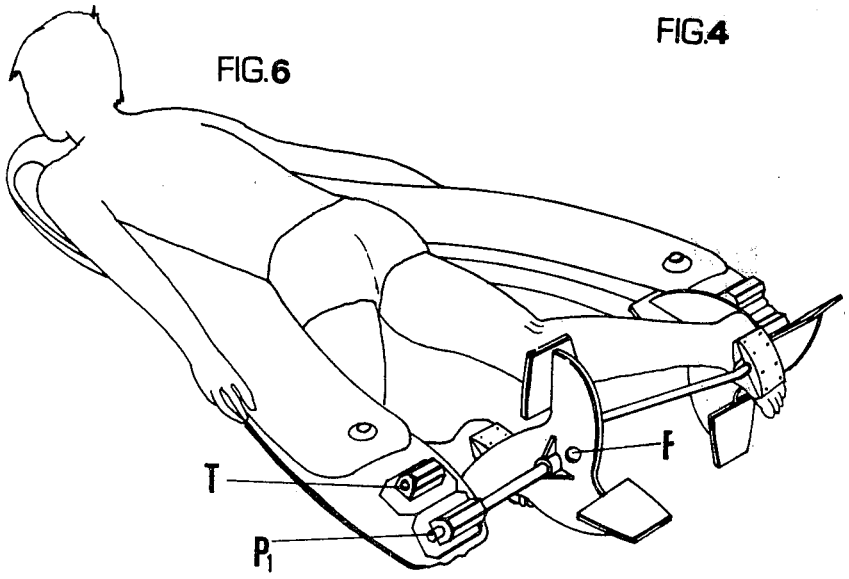

INFLATABLE BOAT INCLUDING A MECHANICAL PROPULSION ASSEMBLY FOR OPERATION BY A USER

This is a continuation-in-part of U.S. patent application Ser. No. 960,179 filed Nov. 13, 1978, now abandoned.

The present invention concerns an inflatable boat including a mechanical propulsion assembly for operation by the legs of the user.

Users of inflatable mattresses or small inflatable boats frequently try to propel them using their arms and legs in order to have not only a floating means, but also a means to move on the water. Young people, in particular, tend to transform the floating means into racing competition devices.

It is, therefore, the aim of the present invention to provide a floating means having a mechanical propulsion assembly operated by the user, the propulsion assembly being of easy and low-cost construction, which can be easily assembled and disassembled. Once disassembled, the device forms a compact block which occupies a small space and is easily transportable.

The object of the present invention is attained in an inflatable boat with a mechanical propulsion assembly, said propulsion assembly being operated by the legs of the user, and the boat essentially consisting of:

- three air chambers connected in the form of a fork, but independently sealed from each other for independently maintaining air pressure;
- propulsion means connected to a throw-like shaft, rotatingly fixed into a support means provided at the ends of each branch of the fork;
- resting means for the user's feet adapted to receive a push from the legs of the user for operating the mechanical propulsion assembly;
- means which permit the disassembly of the boat to form a block, which occupies a small space and is easily transportable.

According to the present invention, a substantially fork-shaped base air chamber has disposed thereon air chambers along the fork's branches each extending onto a forward part of the base air chamber, which are independently sealed from each other, as well as from the base air chamber, for sealing and maintaining of air pressure. Thus, each air chamber forms a separate independent container. The air chambers are preferably of P.V.C., each with a sealable air inlet.

On the outer end of each of the two fork branches are welded two bushes of thermoplastic resin. Each bush on a branch forms, together with a corresponding bush on the other branch, a support couple in which the ends of a throw-shaft are inserted. The throw-shaft carries the propulsion means which the user operates with his legs. The two brush couples are disposed at different distances rearward so that the propulsion shaft may be placed at different distances from the user's feet, according to the height of the user.

According to the present invention, into said support bushes, which are adapted to receive the ends of the propulsion shaft, are included tubular sleeves of self-lubricating material. The sleeves may project beyond the ends of the bushes.

The propulsion means consists of paddle elements which are preferably of polypropylene or of A.B.S. In one embodiment, a tubular sleeve projects from the center of each paddle element. The sleeve has a diameter greater than the diameter of the throw-shaft. The paddle elements can, therefore, be slipped over and keyed to the ends of the throw-shaft, and blocked on the ends by means of a blocking through-pin, so as to integrally rotate with the shaft. Holes, provided in the shaft and in the sleeve for the passing of the relative blocking pin, are located in positions which key the two paddle elements, reciprocally offset at $\alpha/2$, $\alpha$ being the angle between adjacent paddles on each element. Thus, a better distribution and a better continuity of the propulsion is obtained. The ends of the throw-shaft, with the paddle elements mounted in this way, are inserted into the bushes of one of the couples, i.e. into the advanced or the back couple of bushes. Small elastic pins or split pins are inserted into holes in the ends of the shaft outside the bushes. The elastic pins or split pins act as a blockage to prevent the shaft coming out of the bushes.

In a second embodiment of the invention, each paddle element includes means for engaging a part of the throw-shaft which is disposed normal to the direction of the couple.

Furthermore, in the areas of the two throws of the shaft, two shoe-like sheaths are provided for the user's feet to operate the shaft. The uppers of the sheaths are adjustable. Said sheaths rotate around a sleeve on the shaft, and are connected therewith for rotation without laterally moving along the throw-passage of the shaft.

Finally, each paddle element may be provided with an off-center hole. Each off-center hole allows the tubular sleeve to the other element to pass thereinto so that the two paddle elements nest compactly to permit storing the boat in a small space. Once the air has been let out of the boat, the inflatable part can be folded or rolled and placed within the nested paddles of the propulsion elements.

According to the above, a floating means is provided with propulsion means operable by the feet of the user. The boat according to the present invention is easy and inexpensive to build and can be assembled and disassembled in a manner which occupies very little space and is easily transportable.

The above, and other objects, features and advantages of the present invention will become apparent from the following description read in conjunction with the accompanying drawings, in which like reference numerals designate the same elements.

FIG. 4 is an axonometric view showing the assembling of the disassembled elements into a transportable block.

FIG. 5 is a top view of the boat showing the manner of assembly ready for use.

FIG. 6 is a perspective view, showing a person in an operating position on a boat, according to the present invention.

Figures 1, 2, 3:
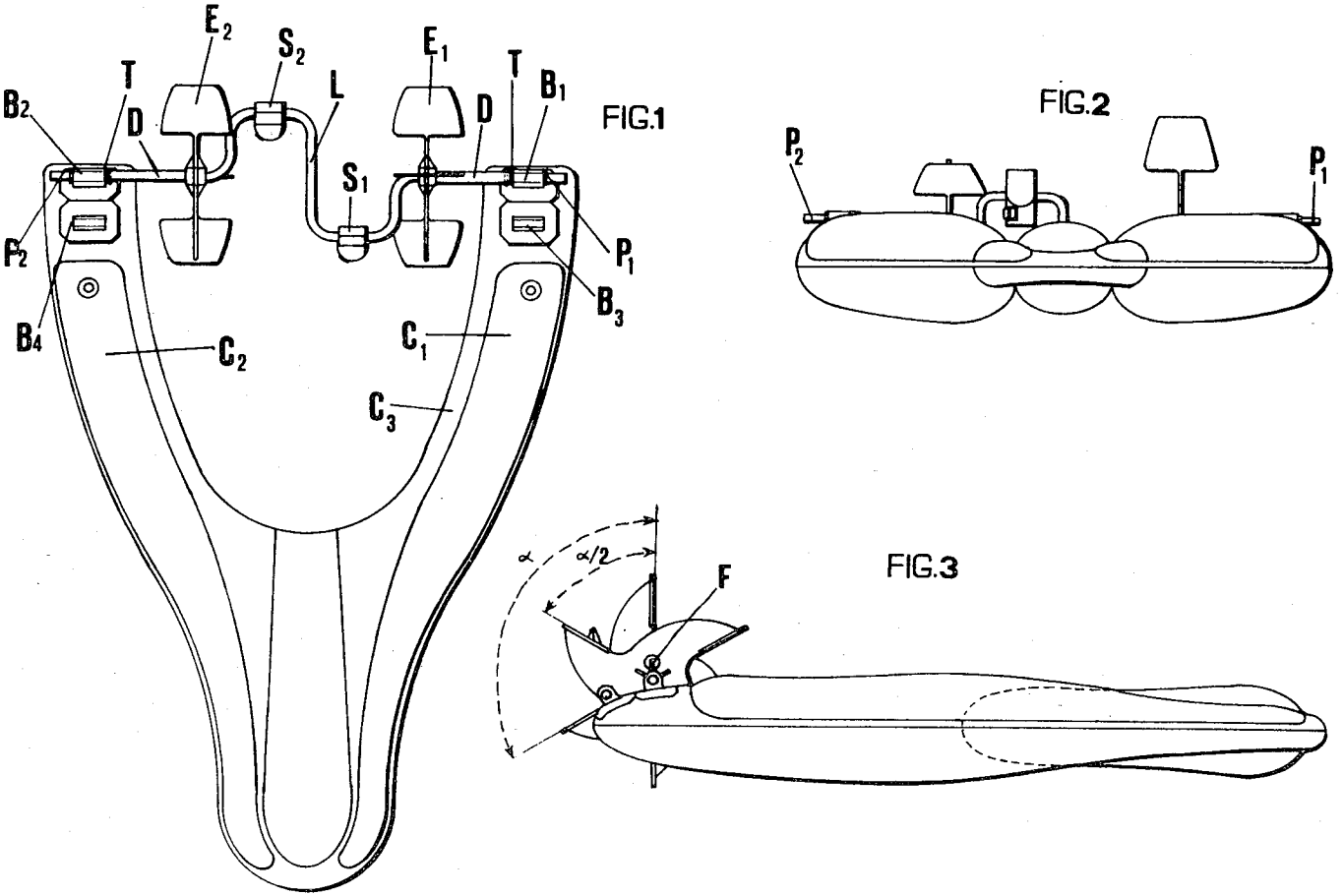
FIG. 1 is a top view of an inflatable boat according to an embodiment of the present invention, the boat being ready for use, and the pedal shaft in its rearmost position.
FIG. 2 is a front view of the boat of FIG. 1, with the pedal shaft in its advanced position.
FIG. 3 is a lateral view, with the pedal shaft in the position according to FIG. 2.
Figure 7:
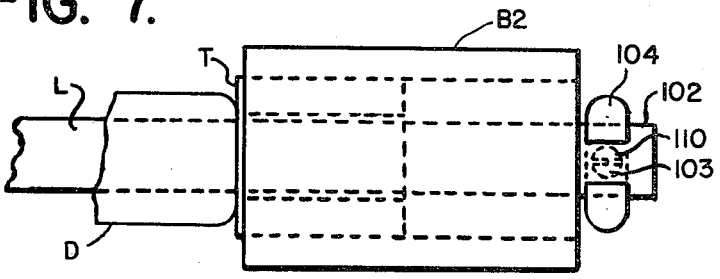
FIG. 7 is a closeup view of a bush with an end of the throw-type shaft passing therethrough showing the means for blocking removal of the shaft from the bush.

Referring to FIG. 1, a boat according to the present invention includes three air chambers C1, C2 and C3. The three air chambers are connected together to form a single inflated fork-like body. All three air chambers remain sealed and separated from each other so as to independently maintain air pressure therein. The air chambers are made of elastic material, preferably polyvinyl chloride, of an appropriate thickness, e.g. 0.55 mm. The two lateral air chambers C1 and C2 are integrally connected and overlaid on respective branches of the central air chamber C3. Thus, air chambers C1, C2 and C3 are adapted to be filled with air, and beyond representing a security feature, they also give the boat its complete shape. On the extremity of each branch of the fork-like part of the boat, bushes B1, B2, B3 and B4 are welded. The bushes B1, B2, B3 and B4 are preferably of thermoplastic resin, and are disposed to form couples B1 and B2, and B3 and B4. Each couple is aligned along an axis which is normal to the longitudinal axis of the boat. Referring also to FIG. 7, in each one of said bushes B1, B2 and B3, B4, a tubular sleeve T of self-lubricating material (nylon or similar) is pressed, so as to project substantially past the ends of its bush.

The ends of a throw-shaft L are inserted into the aft-most couple of bushes B1, B2 or into the front couple of bushes B3, B4 according to the height of the user. Throw-shaft L is preferably a one piece, tubular stainless-steel member having an appropriate diameter and thickness. The ends 102 of shaft L, projecting beyond bushes B1, B2 of B3, B4 include holes 103 into which elastic pins or split pins P1, P2 may be inserted so as to prevent dislodging the shaft L slipping out of the bushes, during rotation. However, it should be noted that elastic pins P1, P2 are very rarely subjected to any force during use of the boat, sice the two ends of the boat are preferably biased inwardly when inflated. In the preferred embodiment, a retaining split ring 104 is fitted over throw-shaft L.

Figure 8:
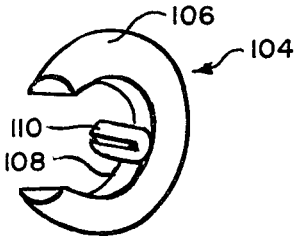
FIG. 8 is a closeup view of a retaining split ring.

As seen in FIG. 8, retaining split ring 104 includes a partial ring 106 having an inner diameter 108 sized to grasp throw-shaft L. A split tang 110 projecting inward from inner diameter 108 enters hole 103 (FIG. 7) and is held in place both by the springiness of partial ring 106 and by the tightness of split tang 110. A second retaining split ring 104 may be used on throw-shaft L inside bushes B1, B2, B3 and B4.

Figure 9:
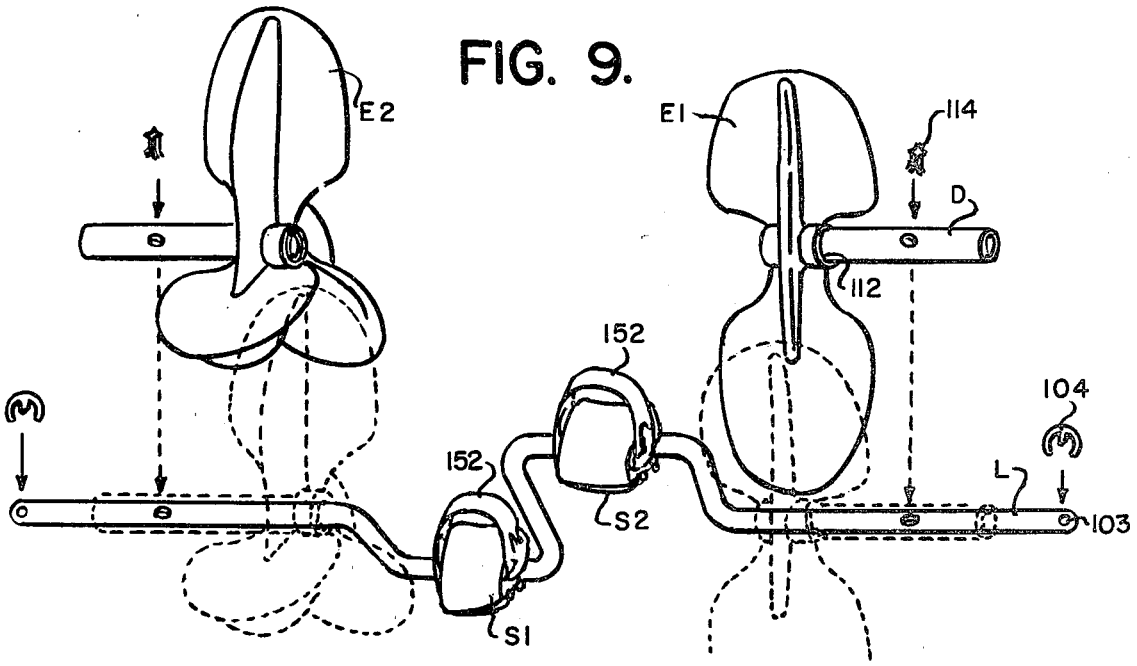
FIG. 9 is a perspective view of the shaft and paddle wheels showing the means for connection therebetween.

On the two ends of shaft L are keyed two paddle propulsion elements E1 and E2. Paddle elements E1 and E2 are, e.g., of polypropylene or of A.B.S. As best seen in FIG. 9, a tubular sleeve D of self-lubricating material is fixed in the central hole of each propulsion element E1 and E2. Keying is accomplished employing, for example, relative blocking pins, passing through aligned holes in shaft L and tubular sleeve D. The positioning of tubular sleeve D determines the right and the left propulsion element. Tubular sleeve D is placed with one of its ends in contact with tubular sleeve T (FIG. 7) projecting with bushes B1, B2, respectively B3, B4 and is keyed to throw-shaft L by a cotter pin 114 or other suitable means. FIG. 7 is a detail of FIG. 10. Reference numeral B2 has been used, but it should be noted that it is equivalent to B1, B3 or B4 depending on the observation point.

Figure 10:
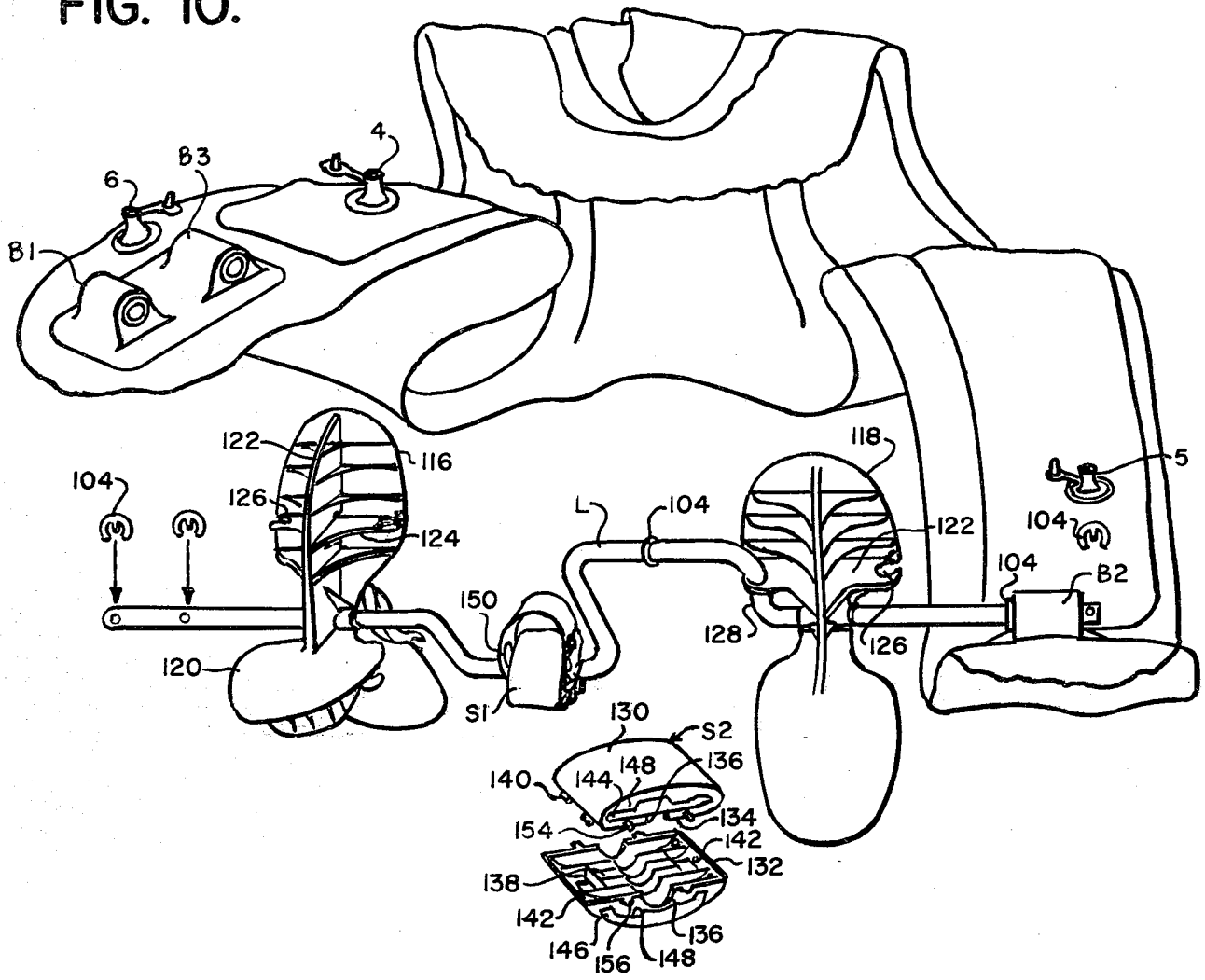
FIG. 10 is an embodiment of the invention showing an alternate means of keying the paddle wheel to the throw-type shaft.

An alternative means of keying propulsion elements to a throw-shaft is shown in FIG. 10. Propulsion elements 116 and 118 include three paddle wheel blades 120 which are stiffened on their rear sides by dorsal and lateral webs 122. A crossbar 124 at the back of each paddle 120 includes semicircular openings 126 at each lateral edge thereof. Each semicircular opening encompasses slightly more than 180 angular degrees and provides a snap fit over the transverse portion 128 of throw-shaft L. Thus, semicircular opening 126 keys its respective propulsion element 116 or 118 to throw-shaft L without requiring additional parts such as, for example, cotter pins.

Shoe-like sheaths S1 and S2 are disposed centered on the throws of throw-shaft L. Sheath S2 is shown disassembled to illustrate the manner in which it is put together and maintained centered on its throw.

A retaining split ring 104 is centered on a throw of throw-shaft L. Shoe-like sheath S2 includes an upper portion 130 against which the foot of a user may press and a lower portion 132 which locks together with upper portion 130 about the throw of throw-shaft L. A plurality of webs 134 in both upper and lower portions 130 and 132 include semicircular depressions 136 which, when upper and lower portions 130 and 132 are properly mated, form an aligned series of circles which rotatably support sheath S2 on the throw of throw-shaft L.

One pair of webs 13 on upper and lower portions 130 and 132 (not seen on 130) are spaced apart for a loose fit against opposed sides of retaining split ring 104 on the throw of throw-shaft L. Retaining split ring 104 thus secures sheath S2 centered in the throw of throw-sheath L and prevents it from sliding from side to side.

Hook-like members 140 are provided at each end of upper portion 130 for engagement with mating holes 142 in lower portion 132. Assembly can thus be performed by snapping together upper and lower portions 130 and 132 without the use of tools.

Guide flanges 144 and 146 of each side of upper and lower portions 130 and 132, respectively, include guide openings 148 for guiding and retaining straps 150 of an upper 152.

Semicircular pins 154 in upper portion 130 mate with semicircular pins 156 in lower portion 132 to form a generally circular pin which may be employed to lock sheath S2 (or S1) together.

Figure 11:
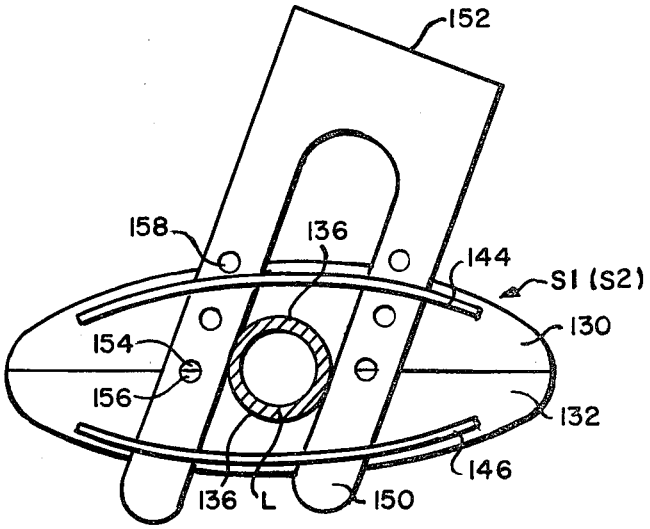
FIG. 11 is a side view of a shoe-like sheath for accommodating the foot of a user on the throw-type shaft.

Referring now to FIG. 11, it will be seen that straps 150 are threaded through guide flanges 144 and 146 at an angle with respect to the axis of sheath S1. A plurality of holes 158 are provided in straps 150. Any corresponding pair of holes 158 may be pressed over the circular boss or pin formed by mating semicircular pins 154 and 156 to secure upper 152 in a position which accommodates the size of the user's foot. When holes 158 are snapped over the bosses formed by semicircular pins 154 and 156, upper and lower portions 130 and 132 are firmly locked together, thus augmenting the locking ability of hook-like members 140 and mating holes 142 (see FIG. 10).

According to FIG. 3, propulsion elements E1, E2 are offset with respect to each other at an angle of $\alpha/2$, $\alpha$ being the angle formed by two subsequent paddles of each element.

On the plane of each propulsion element E1, E2, a hole F is formed through which tubular piece D of the other of the two propulsion elements E1, respectively E2 may pass, for packing the boat so to form a compact transportable block. Once the air has been let out of the boat, the boat can be rolled up, as shown in FIG. 4 and placed between the paddles of propulsion elements E1 and E2, said paddles being put together in the above described way with tubular pieces D passing through holes F. Throw-shaft L may remain inserted in one of the tubular elements D of one of the propulsion elements E1, E2. Thus, a block is obtained, which takes little space and which can be easily transported.

FIG. 5 shows, in dotted lines 1 and 2, the operations which are performed to mount the paddle-propulsion elements E1, E2, by keying the respective tubular pieces D onto throw-shaft L. Dotted line 3 shows which operation has to be performed to apply throw-shaft L, with elements E1, E2 already mounted, into bushes B1, B2 or B3 and B4. References 4, 5 and 6 show the apertures for air inlet into air chambers C1, C2 and C3.

Having described specific embodiments of the invention with respect to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An inflatable boat comprising:

a unitary inflatable structure including a base air chamber and first and second branch air chambers;

said inflatable base air chamber having a central member and first and second branches forming a fork shape;

said first inflatable branch air chamber being overlaid at least on said first branch;

said second inflatable branch air chamber being overlaid at least on said second branch;

said inflatable base air chamber, and first and second inflatable branch air chambers being flexible, independently inflatable, and being effective when inflated to impart said fork shape and a semi rigidity to said boat and being deflatable to permit folding of the inflatable air chambers into a substantially reduced space;

first and second mutually aligned bushes integrally disposed at corresponding first positions on said first and second branches, respectively;

third and fourth mutually aligned bushes integrally disposed at corresponding second positions on said first and second branches, respectively;

a throw-type shaft selectively fittable into said first and second bushes or into said third and forth bushes spanning ends of said fork shape and having a length exceeding a distance between outsides of said first and second bushes and said third and fourth bushes whereby ends of said throw-type shaft project beyond said bushes;

removable means in said ends for blocking removal of said ends from said first and second bushes or said third and fourth bushes;

at least one paddle wheel on said throw-type shaft within said fork shape;

means for keying said at least one paddle wheel to said throw-type shaft;

a spacing between said first and second branches being effective to permit legs of a user whose torso is supported on said central member to project downward therethrough while feet of the user rotate said throw-type shaft; and said first and second positions being at different longitudinal distances from said central member whereby different leg lengths of the user are accommodated.

2. An inflatable boat according to claim 1, wherein said unitary inflatable structure is polyvinyl chloride film.

3. An inflatable boat according to claim 1, wherein each of said inflatable base air chamber, and first and second branch air chambers include air inlets.

4. An inflatable boat according to claim 1, wherein said first, second, third and fourth bushes are of thermoplastic material and include therein a tubular sleeve of self-lubricating material.

5. An inflatable boat according to claim 4, wherein said self-lubricating material is plastic.

6. An inflatable boat according to claim 1, wherein said means for keying includes a central hole in said at least one paddle wheel, a tubular sleeve non-rotatably affixed in said central hole, said sleeve fitting over said throw-type shaft, matching holes in said sleeve and said throw-type shaft, and a pin fitting through said matching holes for preventing relative rotation between said sleeve and said throw-type shaft whereby rotation of said throw-type produces corresponding rotation of said paddle wheel.

7. An inflatable boat according to claim 1, wherein said at least one paddle wheel includes first and second paddle wheels, each of said paddle wheels including a plurality of equally angularly spaced paddles, said means for keying being effective to angularly displace corresponding paddles of said first and second paddle wheels an angular amount equal to half the equal angular spacing between adjacent paddles on the same paddle wheel.

8. An inflatable boat according to claim 1, wherein said throw shaft includes first and second shoe-like sheaths for actuation by the user's feet.

9. An inflatable boat according to claim 1, wherein said means for keying includes a portion of said at least one paddle wheel having an opening at an edge thereof, said opening being displaced from an axis of said at least one paddle wheel and having a size substantially equal to size of said throw-type shaft, and means for snap fitting said opening over a throw portion of said throw-type shaft whereby rotation of said throw-type shaft produces corresponding rotation of said at least one paddle wheel.

10. An inflatable boat according to claim 1, wherein said removable means include a semicircular retaining split ring, said split ring including an inner diameter substantially matching an outer diameter of said ends of said throw-type shaft, said split ring being substantially flexible and effective to snap over said throw-type shaft and thereafter to grasp and tend to hold itself in place on said throw-type shaft, an inwardly directed tang inside said split ring, said tang being effective to enter a hole in said throw-type shaft and to resist motion of said split ring on said throw-type shaft.

* * * * *